US010345037B2

(12) United States Patent
Kim et al.

(10) Patent No.: US 10,345,037 B2
(45) Date of Patent: Jul. 9, 2019

(54) REFRIGERATOR

(71) Applicant: SAMSUNG ELECTRONICS CO., LTD., Suwon-si, Gyeonggi-do (KR)

(72) Inventors: Po Cheon Kim, Suwon-si (KR); Sun Hwan Joo, Suwon-si (KR); Sung Mo Kim, Seoul (KR); Youn Tae Shin, Suwon-si (KR); Sang Cheol Lee, Bucheon-si (KR); Oun Gu Lee, Seoul (KR); Woo Chul Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/652,935

(22) Filed: Jul. 18, 2017

(65) Prior Publication Data

US 2018/0031312 A1 Feb. 1, 2018

(30) Foreign Application Priority Data

Jul. 28, 2016 (KR) ..... 10-2016-0096485

(51) Int. Cl.
*F25D 29/00* (2006.01)
*F25D 23/02* (2006.01)
*F25D 23/12* (2006.01)

(52) U.S. Cl.
CPC ..... *F25D 29/005* (2013.01); *F25D 23/028* (2013.01); *F25D 23/12* (2013.01);
(Continued)

(58) Field of Classification Search
CPC .... F25D 29/003; F25D 29/005; F25D 29/008; F25D 2323/02; F25D 2323/06;
(Continued)

(56) References Cited

U.S. PATENT DOCUMENTS 6,098,411 A * 8/2000 Jeon ..... F25D 29/005 236/94
7,108,342 B2 * 9/2006 Shin ..... F25D 23/025 312/404

(Continued)

FOREIGN PATENT DOCUMENTS

CN 202432810 U * 9/2012
CN 202432810 U 9/2012

(Continued)

OTHER PUBLICATIONS

Extended European Search Report dated Nov. 2, 2017 in corresponding European Patent Application No. 17179358.1, 9 pp.

(Continued)

*Primary Examiner* — Andrew M Roersma
(74) *Attorney, Agent, or Firm* — Staas & Halsey LLP

(57) ABSTRACT

A refrigerator includes a speaker assembly disposed on an upper side of the cabinet so as to be inclined forward, and the speaker assembly is disposed to be exposed to the outside to efficiently transmit sound to the outside of the refrigerator. Further, the cover member disposed on the upper side of the speaker assembly may prevent the penetration of water, foreign matter, etc. on the outside. The refrigerator also includes a rotatable USB port located above the door so that the user may easily connect the USB device to the USB port.

10 Claims, 13 Drawing Sheets

(52) U.S. Cl.
CPC ..... *F25D 29/008* (2013.01); *F25D 2323/022* (2013.01); *F25D 2400/36* (2013.01); *F25D 2400/361* (2013.01)

(58) Field of Classification Search
CPC ..... F25D 2400/36; F25D 2400/361; F25D 2400/40; F25D 23/028; F25D 23/065; F25D 23/12
See application file for complete search history.

(56) References Cited

U.S. PATENT DOCUMENTS

| | | | | |
|---|---|---|---|---|
| 7,404,298 | B2 * | 7/2008 | Kim | F25D 23/12 248/27.1 |
| 7,707,846 | B2 * | 5/2010 | Trulaske, Sr. | A47F 3/04 248/692 |
| D689,038 | S | 9/2013 | Poandl | |
| 9,777,958 | B2 * | 10/2017 | Choi | F25D 23/04 |
| 2005/0138948 | A1 * | 6/2005 | Lee | F25D 23/12 62/331 |
| 2007/0056306 | A1 | 3/2007 | Trulaske, Sr. et al. | |
| 2008/0164758 | A1 * | 7/2008 | McCoy | F24C 15/00 307/43 |
| 2008/0165998 | A1 * | 7/2008 | LeClear | D06F 39/00 381/345 |
| 2009/0261701 | A1 * | 10/2009 | Yun | E05F 1/1215 312/405 |
| 2009/0300884 | A1 * | 12/2009 | Morgan | E05F 3/14 16/343 |
| 2015/0211783 | A1 * | 7/2015 | Marutani | F25D 23/02 62/125 |
| 2015/0233629 | A1 * | 8/2015 | Choi | F25D 23/04 312/404 |
| 2016/0014523 | A1 | 1/2016 | Sell | |

FOREIGN PATENT DOCUMENTS

| | | | | |
|---|---|---|---|---|
| CN | 102878774 | A * | 1/2013 | F25D 23/02 |
| CN | 202659011 | U * | 1/2013 | E05D 11/00 |
| CN | 103208841 | A * | 7/2013 | H01R 13/46 |
| CN | 103208841 | A | 7/2013 | |
| CN | 102878774 | B | 10/2014 | |
| CN | 203908182 | U | 10/2014 | |
| JP | 2015-17781 | | 1/2015 | |
| KR | 10-0764279 | | 10/2007 | |
| KR | 10-2007-0109008 | | 11/2007 | |
| KR | 20070109008 | A * | 11/2007 | |
| KR | 20-0441605 | | 8/2008 | |
| KR | 20-2008-0005028 | | 10/2008 | |
| KR | 20-0445476 | | 8/2009 | |
| KR | 10-2013-0027645 | | 3/2013 | |

OTHER PUBLICATIONS

European Office Action dated Feb. 18, 2019 in European Patent Application No. 17179358.1.

* cited by examiner

REFRIGERATOR

CROSS-REFERENCE TO RELATED APPLICATION

This application claims priority to and the benefit of Korean Patent Application No. 10-2016-0096485, filed on Jul. 28, 2016, the disclosures of which is incorporated herein by reference in its entirety.

BACKGROUND

1. Field

The present disclosure relates to a refrigerator having a sound device.

2. Description of the Discussion of Related Art

A refrigerator is a household appliance that keeps food fresh by including storage compartments to store food and a cold air supply device to supply cold air to the storage compartments.

Conventional refrigerators have been used only to store food in a low temperature state. However, in recent years, there is an increasing need for additional functions in addition to food storage.

The refrigerator may be provided with a speaker capable of generating various kinds of warning sounds or generating a sound in conjunction with an image device such as an Liquid Crystal Display (LCD) provided in a refrigerator.

Speakers, however, are devices that transform electrical signals into sound waves and need to be connected to the outside for the transmission of sound waves. Thus, a speaker is separately disposed in a cabinet or a door of the refrigerator, and a large amount of moisture in the refrigerator may cause malfunction of the speaker exposed to the outside.

In addition, since an image device or a communication device is provided in the refrigerator, a Universal Serial Bus (USB) port used to transmit and receive data to and from a control device to control the image device, the communication device, and the speaker is provided in the refrigerator. In this case, a location of the USB port needs to be selected appropriately in refrigerator.

SUMMARY

The present disclosure provides a refrigerator including a speaker.

The present disclosure also provides a refrigerator having a structure for protecting a speaker from moisture.

The present disclosure also provides a refrigerator having a USB port.

In accordance with one aspect of the present disclosure, a refrigerator includes a cabinet, a storage compartment formed inside the cabinet with a front open, a base member disposed on an upper surface of the cabinet, and a speaker assembly including a speaker and a sound output surface configured to output sound generated from the speaker to the outside, the speaker being disposed on the base member.

The sound output surface is provided facing the front of the cabinet and is inclined with respect to the upper surface of the cabinet The sound output surface may be configured to be exposed to the outside of the refrigerator.

The refrigerator may further include a cover member disposed above the speaker assembly to cover the sound output surface.

The cover member may be configured to be able to slide from a first position covering the sound output surface to a second position located behind the first position.

The sound output surface may be provided to be exposed to the outside of the refrigerator when the cover member is positioned at the second position.

A front surface of the cover member may be provided to be opened.

The base member may include a seating portion on which the speaker assembly is seated and provided to penetrate the upper surfaces of the cabinet and a flange bent and extending from an upper side of the seating portion and provided to be supported on the upper surface of the cabinet.

The base member may further include a protection rib protruding upward from the flange and extending along an edge side of the seating portion.

The speaker assembly may further include a first housing having the sound output surface and a second housing having the speaker seated thereon and coupled with the first housing.

The refrigerator may further include a door configured to open or close the storage compartment and including a recess portion, and a USB port provided to be rotatable in the recess portion.

The recess portion is opened toward an upper side of the door, and the USB port rotates between a first direction toward the upper side of the door and a second direction toward a left side or a right side of the door.

In accordance with other aspect of the present disclosure, a refrigerator includes a cabinet, a storage compartment provided inside of the cabinet, a door having a recess portion and being rotatable relative to the cabinet to open or close the storage compartment, a USB connector located inside of the recess portion and including a USB port provided to be rotatable.

The recess portion may have an opening toward one side of the door, the USB connector includes a rotating member configured to rotate the USB port, and the rotating member rotates between a first direction in which the USB port faces the opening and a second direction in which the USB port faces the other side of the door.

The USB connector may include an opening/closing portion extending from one side of the rotating member and configured to open or close the opening, and the opening/closing portion opens the opening when the rotating member faces the first direction and located at a position corresponding to the opening when the rotating member rotates in the second direction to close the opening.

The USB connector may further include a stopper configured to limit rotation of the rotating member, and the stopper limits the rotation of the rotating member by more than 100 degrees from the first direction.

The USB port is provided to be located outside the opening in conjunction with rotation of the rotating member when USB port is faces toward the first direction.

The refrigerator may further include a display unit mounted on the door and a switch electrically connected to the display unit and disposed inside the recess portion.

The switch may be disposed on the rotating member and rotates in conjunction with the rotating member.

The refrigerator may further include a speaker assembly disposed on an upper surface of the cabinet to be inclined with respect to the upper surface of the cabinet, and cover member slidably disposed above the speaker assembly.

The speaker assembly may be selectively exposed to the outside of the refrigerator by sliding the cover member.

In accordance with other aspect of the present disclosure, a refrigerator includes a cabinet, a storage compartment provided inside of the cabinet, a door rotatably coupled to the cabinet to open or close the storage compartment, a speaker assembly disposed on an upper surface of the cabinet and including a speaker and a sound output surface provided to face forward to output sound generated from the speaker to the outside of the refrigerator and to be inclined with respect to the upper surface of the cabinet, and a USB port provided to be rotatable inside the door.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
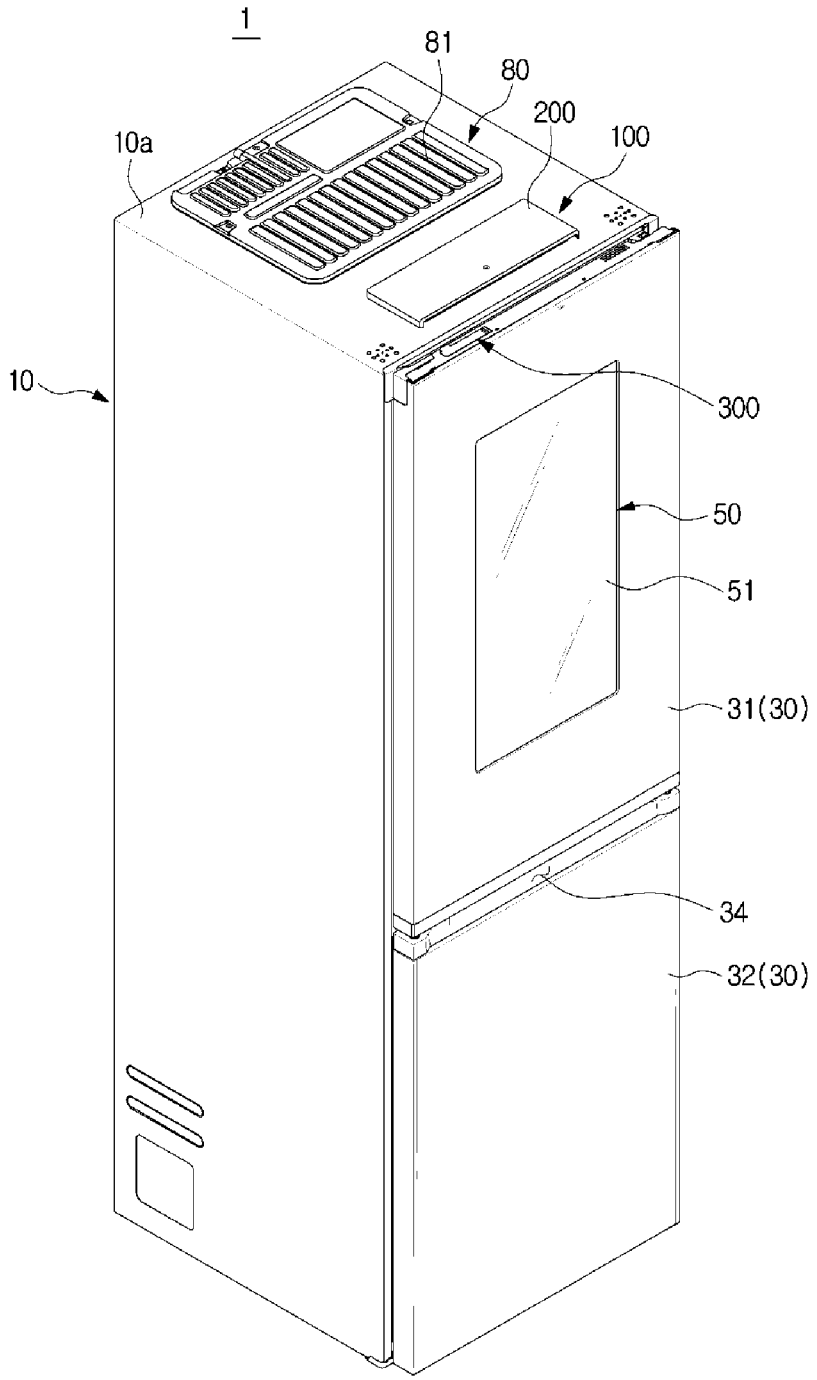
FIG. 1 is a perspective view of a refrigerator according to an embodiment of the present disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~and/or~," or the like.

The terms 'upper', 'upward', 'lower', and 'downward' herein refer to up and down directions based on the upright position of a refrigerator in accordance with embodiments of the present disclosure.

As for the terms 'forward', 'front', 'behind', 'rear or back', a direction in which an opening and a door or doors of the refrigerator are arranged refers to a forward direction, and the opposite direction refers to a backward direction.

Reference will now be made in detail to embodiments, examples of which are illustrated in the accompanying drawings, wherein like reference numerals refer to the like elements throughout.

Generally, a refrigerator is a household appliance that may store food in a fresh state and include a storage compartment configured to store food and a cold air supply device configured to supply cold air to the storage compartment. The refrigerator may be classified according to the type of the storage compartment and the door.

The refrigerator are classified into a bottom mounted freezer (BMF) type refrigerator in which an upper storage compartment serves as a refrigerating chamber and a lower storage compartment serves as a freezing chamber, a top mounted freezer (TMP) type refrigerator in which an upper storage compartment serves as a freezing chamber and a lower storage compartment serves as a refrigerating chamber, a side by side (SBS) type refrigerator in which a storage compartment is divided into left and right sides by a vertical partition wall and a freezing compartment is formed on one side, and a refrigerating compartment is formed on the other side, a French door refrigerator (FDR) type refrigerator in which the storage compartment is divided into upper and lower parts by a horizontal partition and a refrigerator compartment on the upper side which is opened and closed by a pair of doors.

A BMF type refrigerator will be described as an example of the refrigerator according to the present embodiment. However, the BMF type refrigerator will be described for convenience of explanation, but the present disclosure is not limited thereto.

Figure 2:
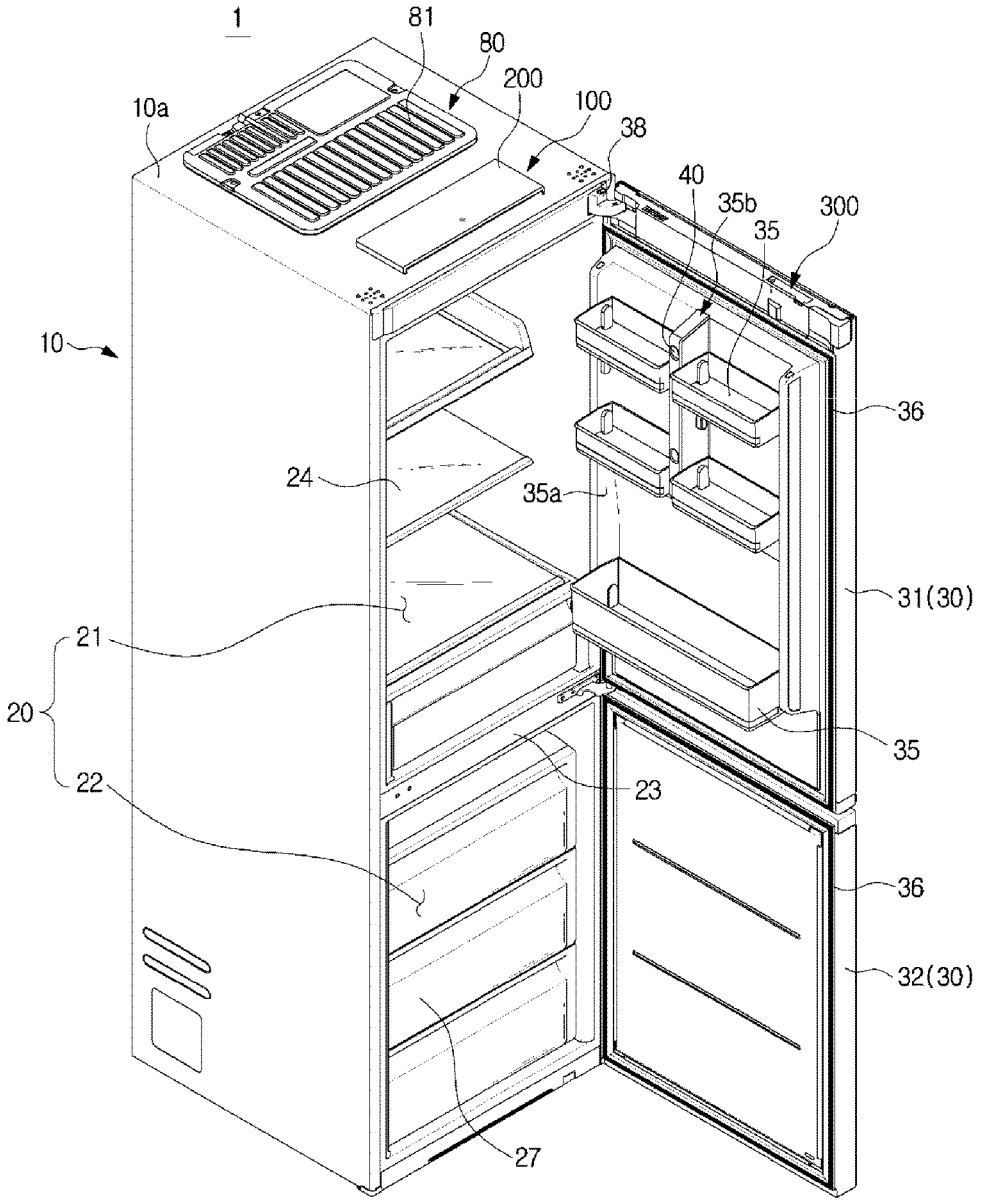
FIG. 2 is a perspective view of a refrigerator according to an embodiment of the present disclosure in which a door is open.

FIG. 1 is a perspective view of a refrigerator according to an embodiment of the present disclosure and FIG. 2 is a perspective view of a refrigerator according to an embodiment of the present disclosure in which a door is open;

A refrigerator 1 includes a cabinet 10, a storage compartment 20 defined in the upper and lower parts of the cabinet 10, a door configured to open or close the storage compartment 20, and a cold air supply device (not shown) configured to supply cold air to the storage compartment 20.

The cabinet 10 may include an inner case defining the storage compartment 20, an outer case coupled to the outer side of the inner case to form an outer appearance, and a thermal insulation material foamed between the inner and outer cases to insulate the storage compartment 20.

The cold air supply device may generate cold air using a cooling cycle that compresses, condenses, expands, and evaporates the refrigerant.

A machine room (not shown) in which a compressor configured to compress the refrigerant and a condenser configured to condense the compressed refrigerant may be provided on the rear lower side of the cabinet 10.

The storage compartment 20 is open to the front and may be partitioned into a first storage compartment 21 on the upper side and a second storage compartment 22 on the lower side by a horizontal partition 23. The refrigerator 1 according to an embodiment of the present disclosure may be a BMF type refrigerator in which the first storage compartment 21 is a refrigerating room and the second storage compartment 22 is a freezing room. However, the embodiment is not limited thereto, and the refrigerator may also be a TMF type refrigerator in which the first storage compartment 21 is a freezing room and the second storage compartment 22 is a refrigerating room. However, for convenience of explanation, the BMF type refrigerator will be used as a reference.

The first storage compartment 21 may be opened and closed by a first door 31 rotatably coupled to the cabinet 10 and the second storage compartment 22 may be opened and closed by a second door 32 rotatably coupled to the cabinet 10. The shape of the door is not limited thereto, and a sliding door that is opened and closed by sliding may also be applied thereto.

The first door 31 configured to open or close the first storage compartment 21 may be rotatably disposed with respect to the cabinet 10 by hinges 38 disposed at upper and lower portions of the front right side of the first storage compartment 21. However, the present disclosure is not limited thereto, and the first door 31 may also be disposed on the left side of the first storage compartment 21.

The hinges 38 may be selectively disposed on the right or left side of the first storage compartment 21 such that the first door 31 may be rotated with respect to the left or right side according to the user's convenience. This is similarly applied to the second door 32.

The first storage compartment 21 is provided with a shelf 24 on which food may be placed, an airtight container 25 to store food under airtight conditions, and a drawer 26 that slides out of the first storage compartment or into the first storage compartment 21. The second storage compartment 22 is provided with a drawer 27 that slides out of the second storage compartment 22 or into the second storage compartment 22.

The storage compartment 20 is opened such that food may be delivered and received, and the opened front may be closed by the door 30.

The first storage compartment 21 may be opened and closed by the first door 31 rotatably connected to the cabinet 10. The second storage compartment 22 may be opened and closed by the second door 32 rotatably connected to the cabinet 10.

On the rear surface of the first door 31, a door shelf 35 to store food may be provided.

The rear surface of the first door 31 may include a first shelf support portion 35*a* vertically extending therefrom to support at least one of the left and right sides of the door shelf 35. The first shelf support portion 35*a* may be detachably installed at the first door 31 in a separate configuration, but it is provided to extend from the rear surface of the first door 31 according to the present embodiment.

The rear surface of the first door 31 may include a second shelf support portion 35*b* extending from a central portion of the rear surface to be perpendicular thereto. With this configuration, the door shelves 35 may be arranged parallel to the rear surface of the first door 31, and may be arranged asymmetrically with respect to the second shelf support portions 35*b*. The second shelf support portion 35*b* may be provided with a camera device 40 to acquire images of the inside of the first storage compartment 21.

The second door 32 may include a lower handle 34 provided at an upper end thereof. The user may easily open or close the second door 32 by grasping the lower handle 34. The lower handle 34 may extend in the lateral direction of the second door 32 and may be recessed inwards. However, the shape of the lower handle 34 is not limited thereto, and any other shapes may also be used as long as it is easily grasped A gasket 36 is provided on the rear edges of the first door 31 and the second door 32 to seal gaps between the first door 31 and the second door 32 in a state where the first door 31 and the second door 32 are closed. The gasket 36 may be installed in the form of a loop along the rim of the rear surfaces of the first door 31 and the second door 32 and may include a magnet (not shown) therein.

The refrigerator 1 according to an embodiment of the present disclosure may further include a display unit 50 having an input/output function. The display unit 50 may be installed on a front panel 31*a* of the first door 31 for the convenience of the user. Information obtained by the camera device 40 may be displayed by the display unit 50 through a control unit (not shown).

The display unit 50 may display various information of the refrigerator 1 and information obtained by the camera device 40 as described above. In addition, the display unit 50 may also display information that is transmitted/received to/from the outside via a communication module (not shown) such as the Internet. Also, information transmitted/received through a USB device connected by a USB connection unit 300, which will be described later, may be displayed on the display unit 50.

The display unit 50 includes a touch screen 51 such that the user may touch the touch screen 51 to operate the refrigerator 1. Also, when at least one home appliance provided in the home is connected through a communication module (not shown) through a network, the at least one home appliance may be centrally controlled through the touch screen 51.

The cabinets 10 may be provided with an electric chamber 80 in which various electric components for driving and controlling the refrigerator 1 are disposed.

The electric chamber 80 may be defined as a space below the upper surface 10*a*, and various electric components may be disposed inside the electric chamber 80. An electric chamber cover 81 covering the electric chamber 80 may be disposed above the electric chamber 80 to protect the electric chamber 80 from the outside of the refrigerator 1.

Hereinafter, a speaker assembly 100 disposed on the upper surface 10*a* of the cabinet 10 will be described in detail.

Figure 3:
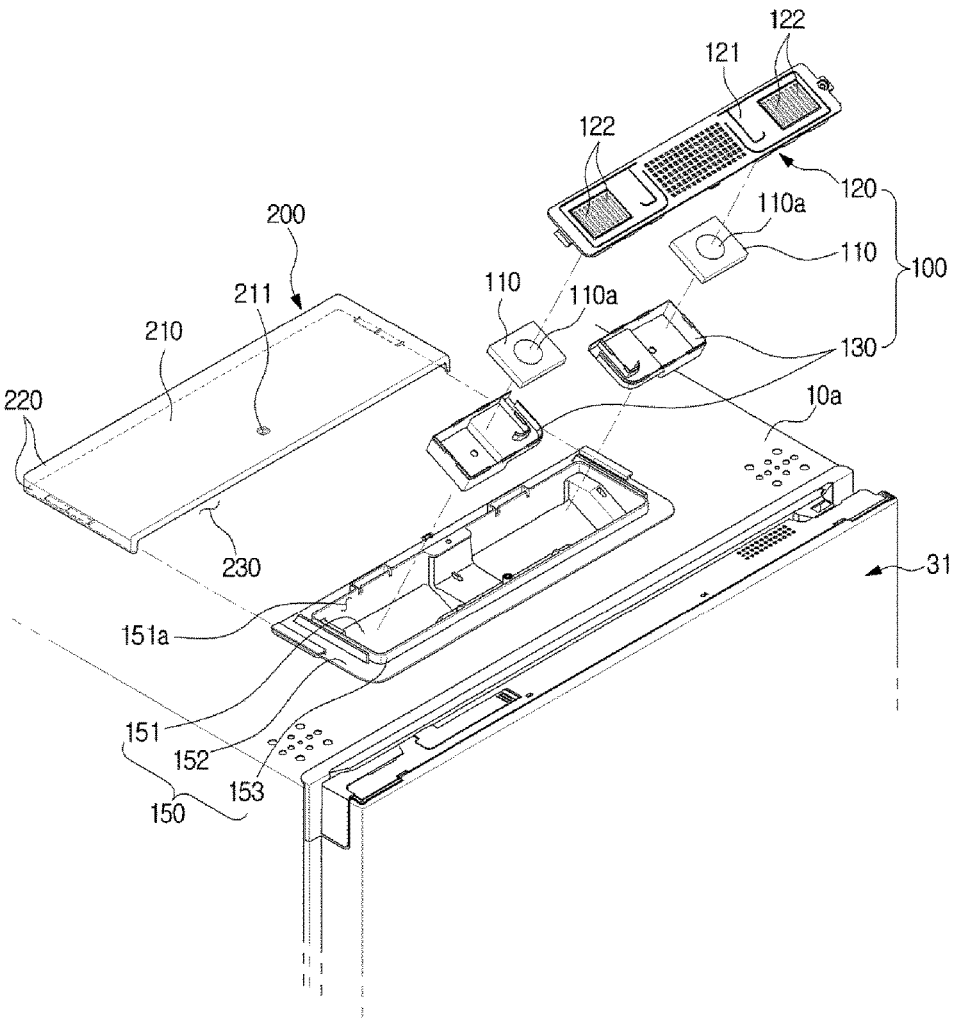
FIG. 3 is an exploded perspective view of a portion of a refrigerator according to an embodiment of the present disclosure.
Figure 4:
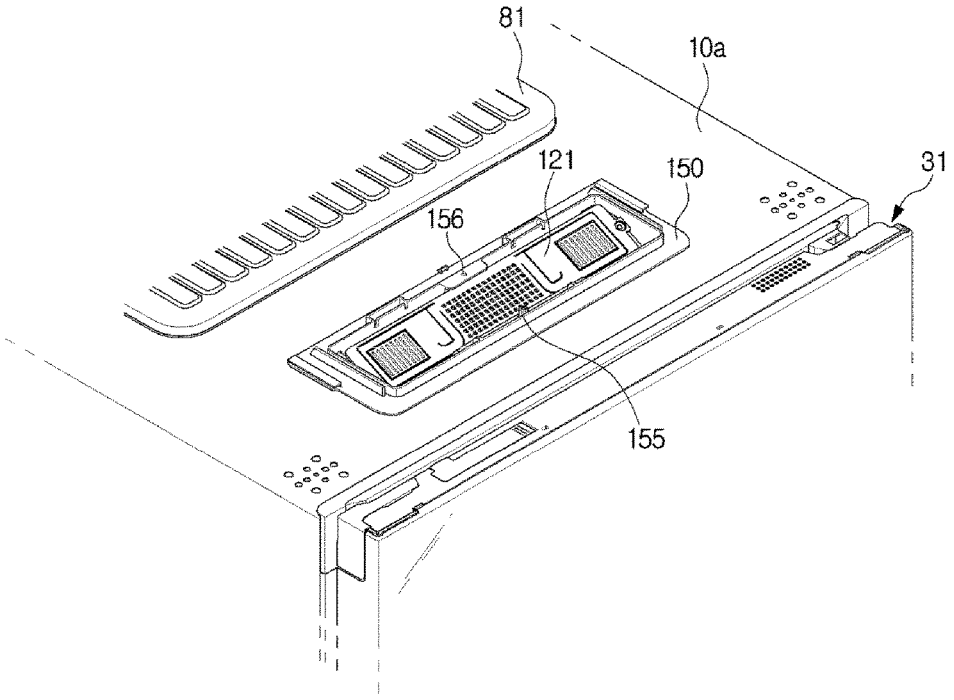
FIG. 4 is a perspective view of a top surface of a refrigerator excluding a cover member of a refrigerator according to an embodiment of the present disclosure.

FIG. 3 is an exploded perspective view of a portion of a refrigerator according to an embodiment of the present disclosure, and FIG. 4 is a perspective view of a top surface of a refrigerator excluding a cover member of the refrigerator according to an embodiment of the present disclosure.

The refrigerator 1 may include a speaker assembly 100.

The speaker assembly 100 is provided to output sound out of the refrigerator 1. Conventional refrigerators have been provided with a buzzer on a PBA (Printed Board Assembly) of the refrigerator to output a warning sound when the door of the refrigerator is opened.

However, since the refrigerator 1 according to an embodiment of the present disclosure outputs not only a simple alarm but also sound of an image medium displayed on the display unit 50 or sound such as music reproduced by a controller (not shown), a separate speaker 110 may be required to output louder sound and sound with higher quality than that of the buzzer installed in the PBA.

In the case of the conventional refrigerator, there is no need to install a separate space for a speaker since the buzzer configuration corresponding to the speaker is disposed in the PBA disposed in the electric chamber. However, the refrigerator 1 according to the embodiment of the present disclosure may require a separate space for arranging the speaker 110 of the speaker 110.

The refrigerator 1 includes the speaker assembly 100 including the speaker 110 and disposed on the upper surface 10*a* of the cabinet 10.

The electric chamber 80 may be disposed on the upper surface 10*a* of the cabinet 10 as described above and the electric chamber cover 81 covering the electric chamber 80 may also be disposed thereon. The speaker assembly 100 may be disposed in front of the electric chamber cover 81 to efficiently output the sound generated by the speaker 110 to consumers.

The speaker assembly 100 may include the speaker 110 for generating sound. The speaker 110 receives an electric signal from a control unit (not shown) and outputs a beep sound, a melody, or a voice informing function control of the refrigerator 1, opening/closing notification of the door 30, and pressing of a control button, music, or sounds of an image displayed on the display unit 50 to the outside.

The speaker assembly 100 may include a first housing 120 including a sound output surface 121 corresponding to the sound output portion 110*a* where the sound of the speaker 110 is generated, and a second housing 130 on which the speaker 110 is mounted and coupled to the first housing 120 at a rear side of the first housing 120.

The speaker assembly 100 may include two speakers 110 and two second housings 130 equivalent thereto as illustrated in FIG. 3. However, the present disclosure is not limited thereto, and the speaker assembly 100 may also include one speaker 110 and one second housing 130. Alternatively, the speaker assembly 100 may include two first housings 120 corresponding to two speakers 110.

Hereinafter, only one speaker 100 and one second housing 130 will be described since the two speakers 110 and the two second housings 130 are identical and symmetrical to each other.

The speaker assembly 100 may be seated on a base member 150 disposed on the upper surface 10*a* of the cabinet 10. Particularly, the speaker assembly 100 may be seated on the base member 150 such that the sound output surface 121 is disposed toward the front of the cabinet 10 and has an inclination with respect to the upper surface 10*a* of the cabinet 10.

The base member 150 having an open top structure may be arranged such that the sound output surface 121 is directly exposed to the outside of the cabinet 10 even when the speaker assembly 100 is seated on the base member 150.

The sound output surface 121 may be provided to be inclined such that the lower side of the sound output surface 121 is disposed closer to the front side of the cabinet 10 than the upper side of the sound output surface 121. The speaker 110 may be inclined to correspond to the sound output surface 121 such that the sound output portion 110*a* and the sound output surface 121 where the sound of the speaker 110 is output may be arranged substantially in parallel The first housing 120 constituting the sound output surface 121 may be inclined to correspond to the sound output surface 121. The first housing 120 may have a plurality of speaker holes 122 to output the sound output from the sound output portion 110*a* to the outside.

The second housing 130 where the speaker 110 is seated may be inclined in correspondence with the speaker 110 and coupled with the first housing 120 from the rear side of the first housing 120.

Accordingly, the entire speaker assembly 100 according to an exemplary embodiment of the present disclosure may be inclined with respect to the upper surface 10*a* of the cabinet 10. However, the present disclosure is not limited thereto and only the sound output surface 121 may be inclined with respect to the upper surface 10*a* of the cabinet 10 and the speaker 110 and the second housing 130 may be disposed on the upper surface 10*a* of the cabinet 10. The sound output surface 121 and the speaker 110 may be arranged in parallel to the upper surface 10*a* of the cabinet 10 and the second housing 130 may be disposed in parallel to the upper surface 10*a* of the cabinet 10.

Although not shown in the drawings, the speaker assembly 100 may be directly mounted on the upper surface 10*a* of the cabinet 10 without the configuration of the base member 150.

Since the sound output surface 121 is inclined toward the front of the cabinet 10, sound may be effectively transmitted forward from the refrigerator 1. Also, since the sound output surface 121 is exposed to the outside of the cabinet 10, the sound may be effectively transmitted to the user without distortion.

Conventionally, the buzzer, which is an element corresponding to the speaker, is covered by the cover member and not directly exposed to the outside of the cabinet, so that the sound transmitted to the user may be slightly distorted. However, according to the embodiment of the present disclosure, such sound distortion may be prevented because the sound output surface 121 is directly exposed to the outside.

The base member 150 may include a seating portion 151 having an open top and on which the speaker assembly 100 is seated, as described above. The seating portion 151 may be disposed between the outer case and the inner case of the cabinet 10 through the upper surface 10*a* of the cabinet 10. That is, at least a portion of the seating portion 151 may be disposed below the upper surface 10*a* of the cabinet 10.

The speaker assembly 100 is mounted on the seating portion 151. Specifically, the rim of the first housing 120 of the speaker assembly 100 is supported on an upper side of the seating portion 151, and thus the speaker 110 and the second housing 130 may be seated on the seating portion 151. (See FIG. 7)

The seating portion 151 is disposed below the upper surface 10*a* of the cabinet 10 so that the speaker assembly 100 is also disposed below the upper surface 10*a* of the cabinet 10. Since the upper side of the seating portion 151 is opened, the sound output surface 121 may be exposed to the outside. Therefore, it is not necessary to secure a space above the storage compartment 20 in order to secure a space in which the speaker assembly 100 is disposed In addition, a part of the upper side of the speaker assembly 100 may be disposed above the upper surface 10*a* of the cabinet 10. Thus, the sound output surface 121 may be exposed to the outside as much as possible.

The lower surface 151*a* of the seating portion 151 may be disposed to be inclined with respect to the upper surface 10*a* so as to correspond to the speaker assembly 100. The speaker assembly 100 may be supported on the upper portion of the seating portion 151 as in the embodiment of the present disclosure. However, the present disclosure is not limited thereto, and the speaker assembly 100 may also be disposed directly on the lower side 151*a* of the seating portion 151.

The base member 150 may include a flange 152 that bends at the upper edge of the seating portion 151 and extends therefrom. The flange 152 allows the base member 150 to be supported by the upper surface 10*a* of the cabinet 10.

In detail, the upper surface 10*a* of the cabinet 10 is provided with a through hole (not shown) through which the base member 150 passes, and the seating portion 151 of the base member 150 passes through the through hole. And the lower surface of the flange 152 and the upper surface 10*a* of the cabinet 10 are in contact with each other so that the base member 150 may be disposed on the upper surface 10*a* of the cabinet 10.

The base member 150 may include a protection rib 153 protruding upward from the flange 152 and extending along the upper edge side of the seating portion 151. The protection rib 153 may prevent water present on the outside from penetrating into the seating portion 151 and flowing into the speaker assembly 100.

Thus, the protective ribs 153 may extend along the upper edge of the seating portion 151 in the form of a single closed curve.

A first engaging hole 155 and a second engaging hole 156 may be provided on the protective rib 153 so that a cover member 200 to be described later may be screwed to the base member 150.

Hereinafter, the cover member 200 will be described in detail.

Figure 5:
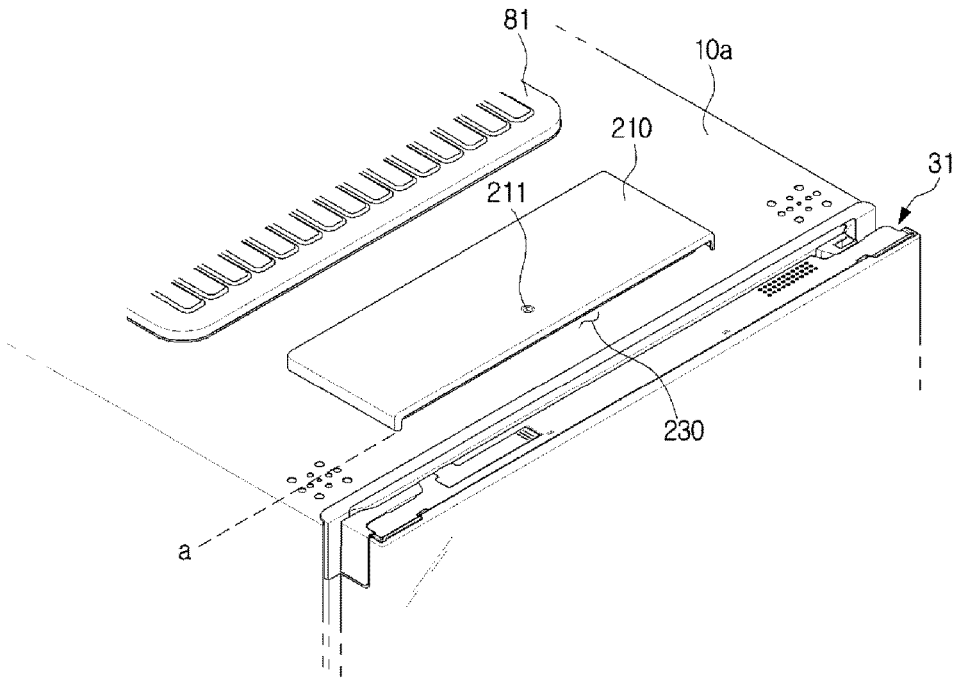
FIG. 5 is a perspective view of a top surface of a refrigerator when a cover member of the refrigerator is disposed at a first position according to an embodiment of the present disclosure.
Figure 6:
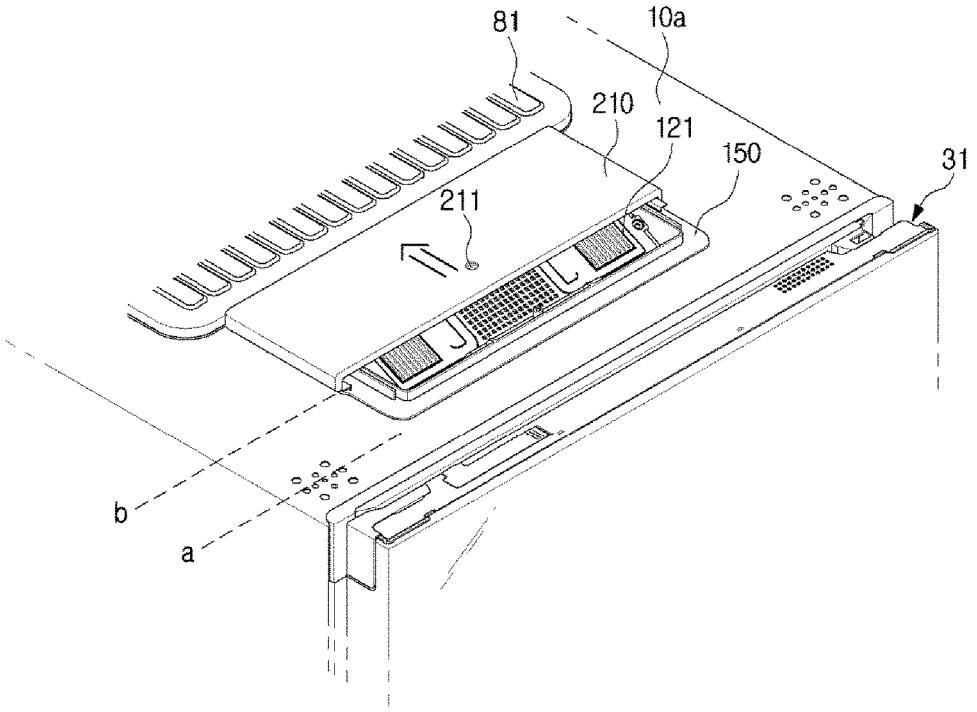
FIG. 6 is a perspective view of a top surface of a refrigerator when the cover member of the refrigerator is disposed at a second position according to an embodiment of the present disclosure.
Figure 7:
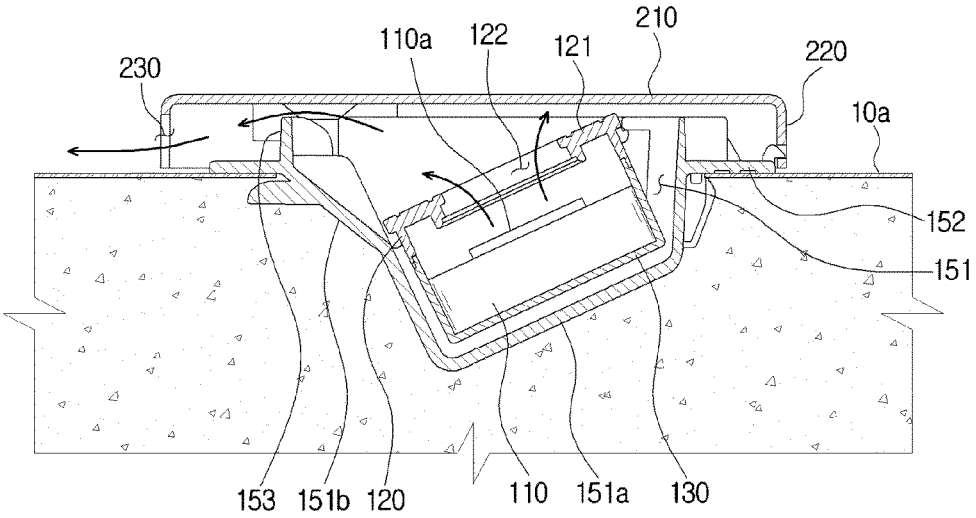
FIG. 7 is a cross-sectional view of an upper portion of a refrigerator when a cover member of the refrigerator is disposed at a first position according to an embodiment of the present disclosure.
Figure 8:
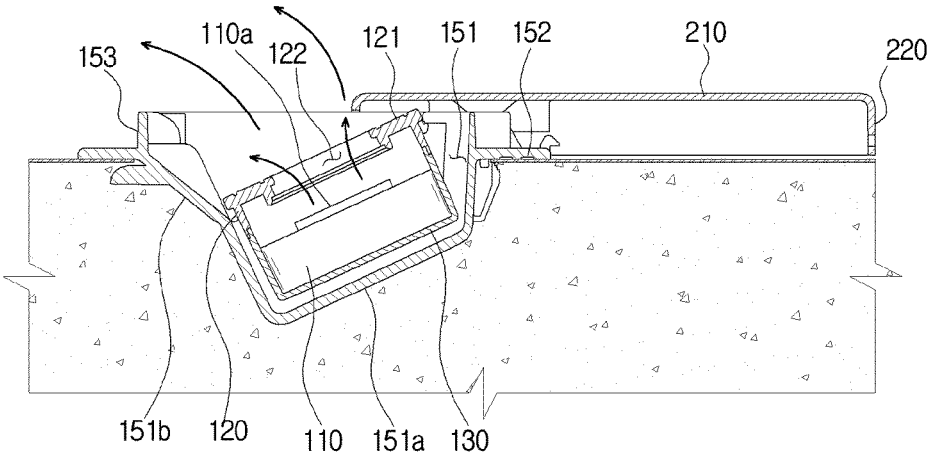
FIG. 8 is a cross-sectional view of an upper portion of a refrigerator when a cover member of a refrigerator is disposed at a second position according to an embodiment of the present disclosure.

FIG. 5 is a perspective view of a top surface of a refrigerator when the cover member of the refrigerator is disposed at the first position according to an embodiment of the present disclosure. FIG. 6 is a perspective view of the top surface of the refrigerator when the cover member of the refrigerator is disposed at the second position according to the embodiment of the present disclosure. FIG. 7 is a cross-sectional view of an upper portion of the refrigerator when the cover member of the refrigerator is disposed at the first position according to the embodiment of the present disclosure. FIG. 8 is a cross-sectional view of the upper portion of the refrigerator when the cover member of the refrigerator is disposed at the second position according to the embodiment of the present disclosure.

The cover member 200 may be disposed on the upper side of the speaker assembly 100. The cover member 200 selectively covers the sound output surface 121 exposed to the outside, thereby blocking exposure of the sound output surface 121 to the outside.

The cover member 200 may have a first surface 210 corresponding to the upper surface 10*a* of the cabinet and a plurality of second surfaces 220 extending from the side edge and the rear edge of the first surface 210 and forming a side surface of the cover member.

A penetrating portion 230 may be provided at the front side of the cover member 200 to be open toward the front and through which the sound generated by the speaker assembly 100 passes.

As described above, since the sound output surface 121 is exposed to the outside, water or foreign substances existing outside of the refrigerator 1 may percolate to the sound output surface 121 while the refrigerator 1 is transported or when the refrigerator 1 is placed outdoors.

In order to prevent percolation of water, when the refrigerator 1 is disposed in a space where water or foreign matter may be introduced into the speaker assembly 100, the cover member 200 may be attached to the speaker assembly 100 to prevent penetration of water or foreign matter.

As shown in FIG. 5, when the penetrating portion 230 is disposed at a first position a, the cover member 200 may cover the entire speaker assembly 100, so that the speaker assembly 100 may be protected from the external water or foreign matter.

As described above, the penetrating portion 230 may allow some water or foreign matter to flow into the open space toward the penetrating portion 230, but the protective rib 153 disposed inside the penetrating part 230 may prevent water or foreign matter from flowing into the inside of the seating portion 151 (refer to FIG. 7).

According to an embodiment of the present disclosure, the penetration portion 230 is provided such that the front surface of the cover member 200 is completely opened. However, the present disclosure is not limited thereto, and the cover member 200 may further include an additional structure that extends from the first surface 210 to partly close the open space.

When the penetrating portion 230 is disposed at the first position a, the coupling hole 211 may be disposed on the first surface 210 to correspond to the first engaging hole 155. The cover member 200 may be engaged with the speaker assembly 100 in a state where the penetrating portion 230 is disposed at the first position a by screw connection between the coupling hole 211 and the first engaging hole 155.

In the case where the refrigerator 1 is disposed in a space as the room that the user generally uses, the penetration portion 230 may be disposed at the second position b on the speaker assembly 100, such that the sound output surface 121 may be exposed to the outside as shown in FIG. 6.

The cover member 200 may be slidably provided on the upper surface 10*a* of the cabinet 10. The cover member 200 may slide between the first position a and the second position b such that the penetration portion 230 is disposed at the first position a and the second position b.

At least one part of the upper side of the speaker assembly 100 and the protection ribs 153 are disposed on the upper surface 10*a* of the cabinet 10. Since the front side of the cover member 200 is formed as the penetration portion 230, the cover member 200 may slide between the first position a and the second position b without being limited by the protective ribs 153 or the upper side of the speaker assembly 100.

Since the refrigerator 1 is usually disposed in an indoor space, the user may use the refrigerator 1 by sliding the cover member 200 backward such that the penetrating portion 230 of the cover member 200 is disposed at the second position b.

The second position b is a rearmost position of the penetration portion 230 in which the cover member 200 may slide backward. Since the electric chamber cover 81 is disposed behind the speaker assembly 100, a position of the penetrating portion 230 where the electric chamber cover 81 and the cover member 200 are in contact with each other by sliding of the cover member 200 backward may be the second position b.

Therefore, the second position b is not limited to the present disclosure, and its position may be changed according to the distance between the electric chamber cover 81 and the speaker assembly 100.

The cover member 200 is slidable further backward so that the second position b may be moved to the rear side of the present disclosure when the electric chamber cover 81 and the speaker assembly 100 are disposed with greater spacing than the embodiment of the present disclosure. And may be disposed further rearward than the embodiment.

The coupling hole 211 and the second engaging hole 156 provided on the first surface 210 may be disposed correspond to each other when the penetration portion 230 is disposed at the second position b, and the coupling hole 211 and the second engaging hole 156 are screwed together so that the cover member 200 is engaged with the refrigerator in a state where the penetrating portion 230 is disposed at the second position b.

As described above, according to the embodiment of the present disclosure, the sound output surface 121 may be exposed to the outside of the cabinet 10 to improve the efficiency of transmitting sound. When the possibility of penetration of the refrigerator 1 by water or foreign substances increases, the refrigerator 1 is driven in a state where the penetration portion 230 of the cover member 200 is disposed at the first position a.

As shown in FIG. 7, even when the cover member 200 is disposed at the first position a covering the entire speaker assembly 100, the sound output through the sound output surface 121 is transmitted through the penetration portion 230 to the front of the cabinet 10.

The lower side of the first surface 210 of the cover member 200 may be spaced apart from the upper side of the protective ribs 153, in order to efficiently output the sound in the forward direction even when the cover member 200 covers the speaker assembly 100, Generally, as shown in FIG. 8, since the refrigerator 1 is driven in a state that the sound output surface 121 is exposed to the outside of the refrigerator 1, the sound may be diverted efficiently toward the front side.

Seating portion 151 may include a guide surface 151*b* provided on the front surface of the seating portion 151 and inclined upward toward the front side of the cabinet 10 to guide the sound output from the sound output surface 121 to the front side of the cabinet 10. In addition, the seating portion 151 may serve as a sounding ring for circulating a part of the sound generated from the speaker 110.

Hereinafter, a USB port connected to a control unit (not shown) of the refrigerator 1 and a USB connection unit including the USB port will be described in detail.

Figure 9:
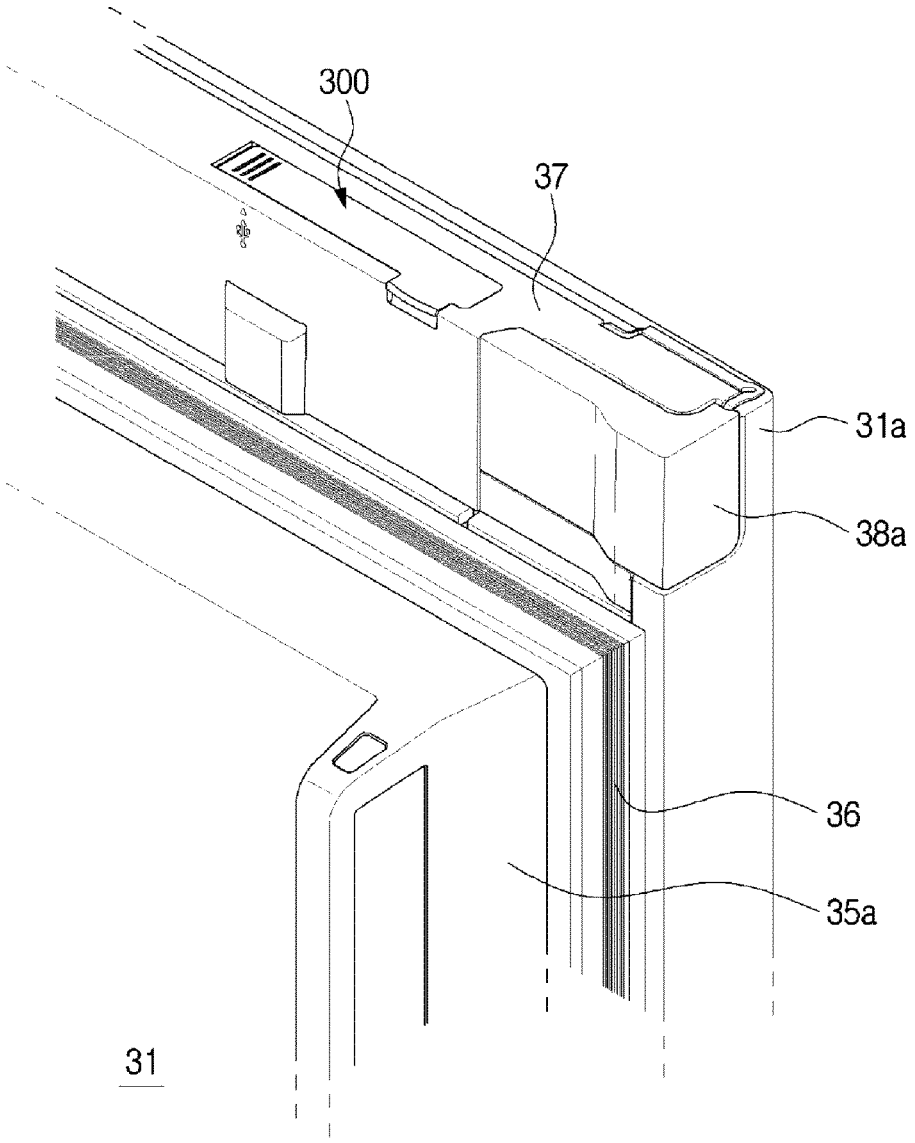
FIG. 9 is a rear perspective view of a refrigerator door according to an embodiment of the present disclosure.
Figure 10:
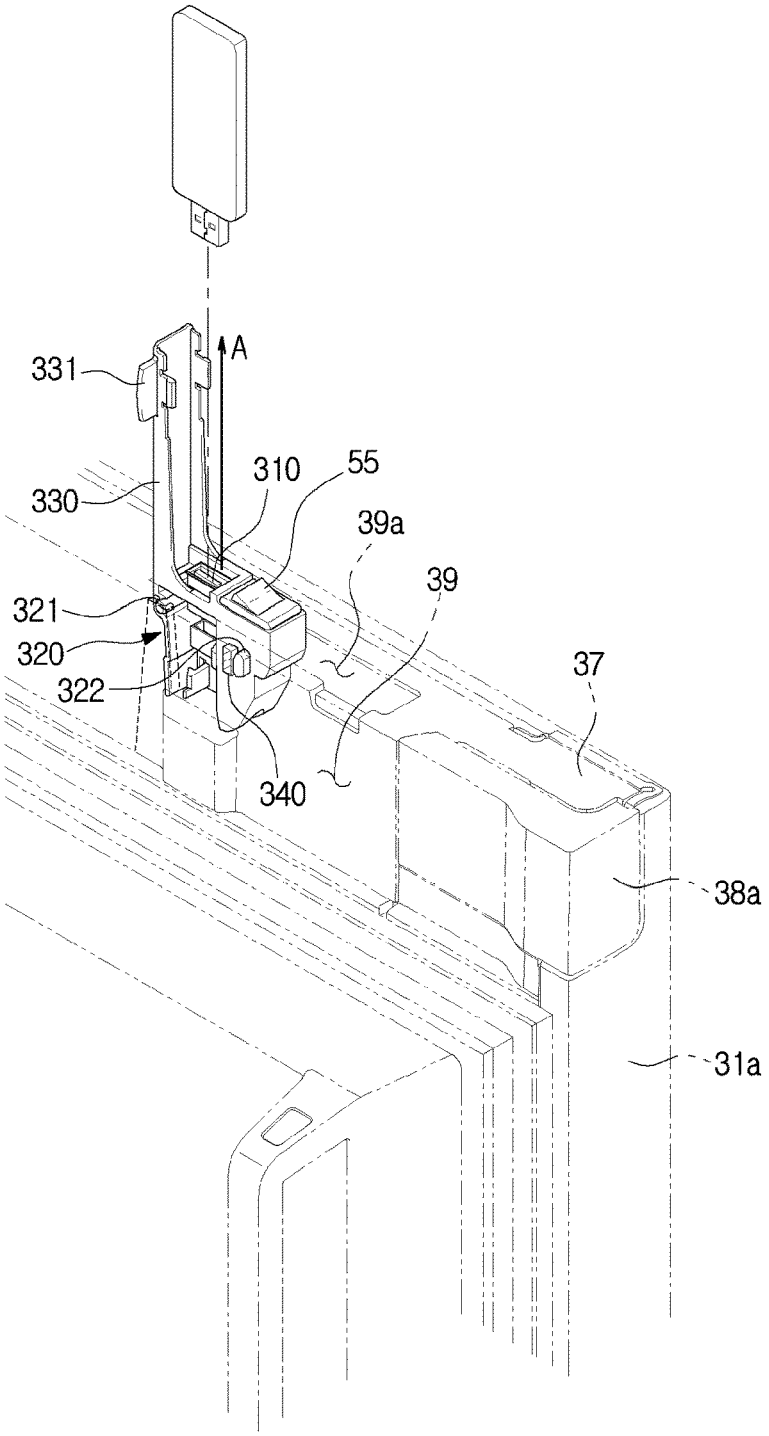
FIG. 10 is a rear perspective view of a door of a refrigerator when a USB port is oriented in a first direction according to an embodiment of the present disclosure.
Figure 11:
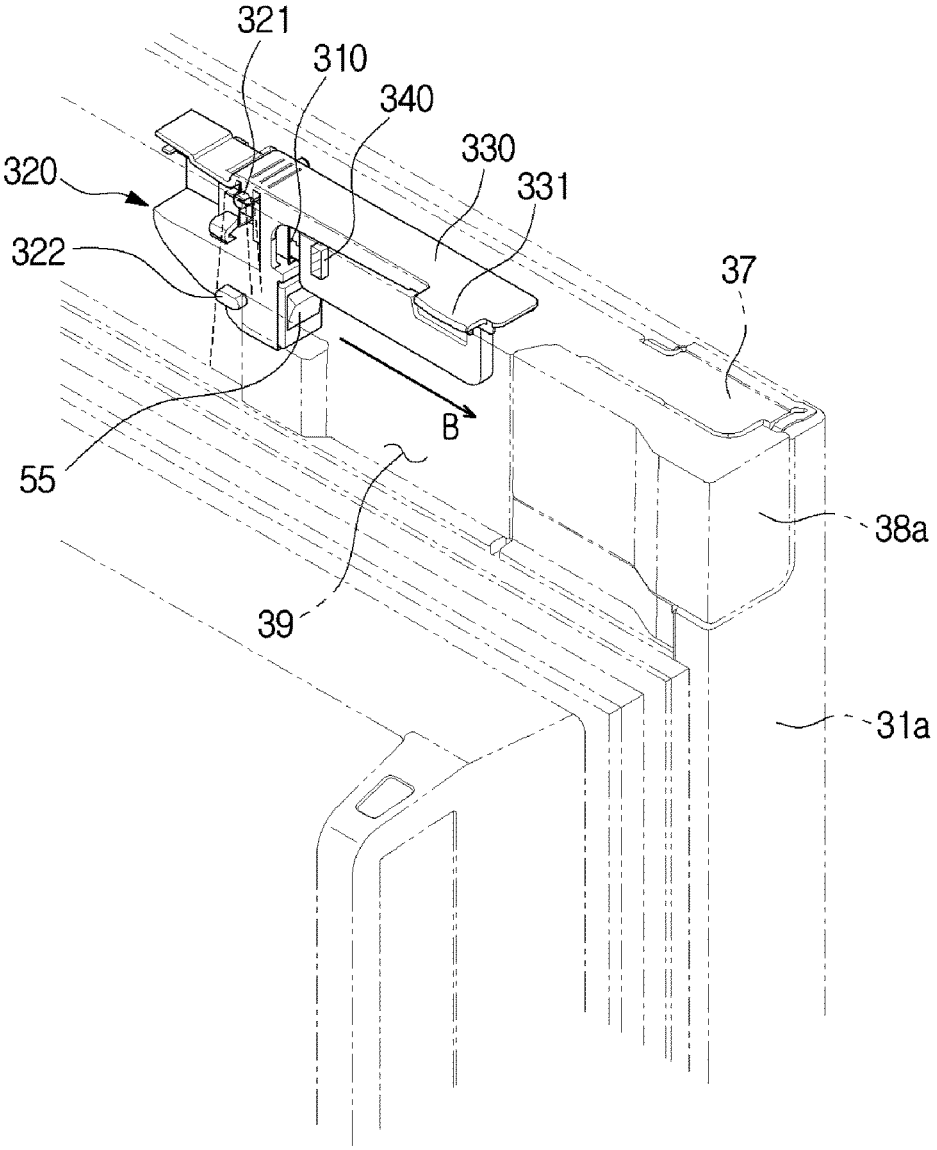
FIG. 11 is a rear perspective view of a door of a refrigerator when a USB port of the refrigerator is oriented in a second direction according to an embodiment of the present disclosure.
Figure 12:
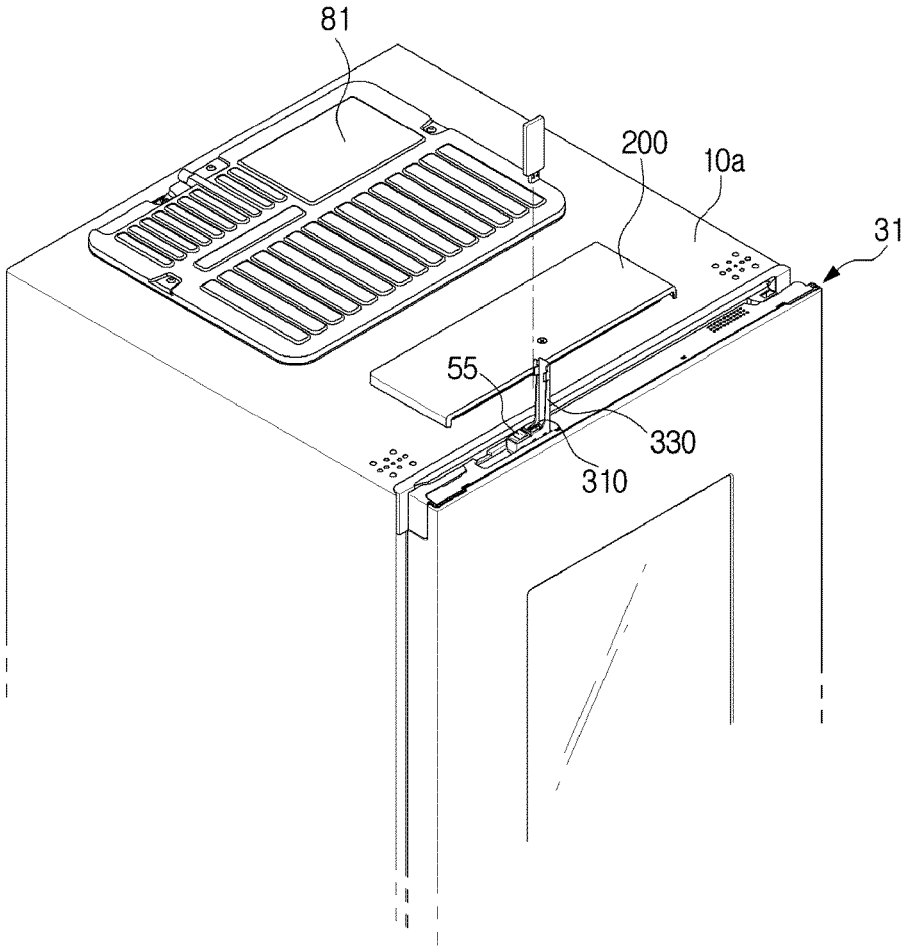
FIG. 12 is a perspective view of a refrigerator when a USB port of the refrigerator is oriented in a first direction according to an embodiment of the present disclosure.

FIG. 9 is a rear perspective view of a refrigerator door according to an embodiment of the present disclosure, FIG. 10 is a rear perspective view of a door when a USB port of a refrigerator is directed in a first direction, FIG. 11 is a rear perspective view of a door when the USB port of the refrigerator is oriented in the second direction according to an embodiment of the present disclosure, FIG. 12 is a perspective view of the USB port of the refrigerator facing the first direction.

As described above, the refrigerator 1 according to an embodiment of the present disclosure may be connected to the Internet through a communication module (not shown), and may control home appliances including other communication modules. In addition, the refrigerator 1 includes the display unit 50 and the display unit 50 may display image information of the refrigerator 1.

Accordingly, the control unit (not shown) of the refrigerator 1 may transmit and receive information to and from external devices and may communicate with the external devices via other communication modules such as Wi-Fi, Bluetooth, Zigbee and Z- And may send and receive information via USB.

The refrigerator 1 according to an embodiment of the present disclosure may include a USB connector 300. The USB connector 300 may be disposed on the first door 31. However, the present disclosure is not limited to this embodiment, and the USB connector 300 may be disposed in a configuration other than the first door 31. Hereinafter, only the case where the USB connector 300 is disposed in the first door 31 will be described.

As shown in FIGS. 9 and 10, the first door 31 includes a front panel 31*a* forming a front surface and a side surface of the first door 31 and a door upper cover 37 disposed above the first door 31.

The front panel 31*a* according to an embodiment of the present disclosure extends from the front surface to the side surface of the first door 31. However, the front surface and the side surface may be formed with separate panels.

The hinge 38 is provided on one side of the upper edge of the first door 31 and a hinge cap 38*a* covering a space in which the hinge 38 may be installed is disposed on the other side of the upper corner As described above, since the hinge 38 of the refrigerator 1 according to the embodiment of the present disclosure is detachably installed on the right and left sides, the hinge cap 38*a* and the hinge 38 may be provided in the space covered by the hinge cap 38*a* to change the rotation direction of the first door 31.

A recess portion 39 including an opening 39*a* opened to the upper side of the first door 31 may be provided on the upper side of the door upper cover 37. The USB connector 300 may be provided in the recess portion 39.

Since the USB connection unit 300 is disposed inside the recess portion 39, the USB port 310 is not exposed to the outside of the first door 31, so that the aesthetics of the refrigerator 1 may be improved. The user may use the USB port 310 by opening the USB connector 300 as needed.

The USB connection unit 300 may include the USB port 310 and a rotating member 320 for rotating the USB port. The USB port 310 may rotate between a first direction A toward the opening 39*a* and a second direction B toward the side of the door (See FIG. 7) by the rotation of the rotary member 320.

The rotating member 320 may be rotated around a rotation axis 321 extending in the front-rear direction of the first door 31. Accordingly, the rotary member 320 and the USB port 310 may be rotated between the upper side and the left side of the first door 31.

The USB connector 300 may further include an opening/closing portion 330 extending from one side of the rotating member 320 and capable of opening and closing the opening 39*a* of the recess portion 39.

As shown in FIG. 9 the opening/closing portion 330 is formed in a shape corresponding to the opening 39*a*, and is disposed on the opening 39*a*, so that the opening/closing portion 330 closes the recess portion 39 not exposed to the outside of the refrigerator 1.

The opening/closing portion 330 may be rotated with the rotating member 320 to open the opening 39*a* while being rotated to the upper side of the first door 31. That is, when the USB port 310 rotates in the first direction A, the opening/closing portion 330 may be rotated together with the rotating member 320 to be spaced apart from the opening 39*a* to open the opening 39*a*.

As shown in FIG. 10, when the rotary member 320 is rotated, the opening/closing portion 330 is opened so that the USB port 310 may be exposed to the outside through the opening 39*a*, and the user may use the USB port 310.

In detail, the user may press an opening/closing handle 331 extending from one side of the opening/closing portion 330 upward, then the opening/closing portion 330 which has closed the opening 39*a* is pressed upward and a force is transmitted to the rotating member 320 so that the rotating member 320 rotates about the rotational axis 321 in the first direction A.

The USB connector 300 may include a stopper 340 that restricts the rotation of the rotating member 320. The stopper 340 may be provided in the shape of a protrusion extending from an inner side of the recess portion 39.

The rotating member 320 may include a protrusion 322 protruding toward one side where the stopper 340 is located. The rotation of the protrusion 322 coupled with the rotating member 320 is restricted by the stopper 340 and cannot be rotated over a certain range.

According to an embodiment, the stopper 340 may be disposed such that the rotating member 320 rotates between the first direction a and the second direction B in which the USB port 310 faces the left side of the first door 31, i.e., in the range of 0 degrees to 100 degrees, preferably between about 0 degrees and about 90 degrees.

Therefore, the rotating member 320 cannot be further rotated in the right direction of the first door 31 in the first direction A by the stopper 340.

The rotating member 320 may be provided with a switch 55 for applying power to the display unit 50. The switch 55 is not exposed to the outside by the opening/closing portion 330 but when the opening/closing portion 330 opens the opening 39*a* by the rotation of the rotating member 320, the switch 55 is exposed to the outside. The user may connect an USB device to the USB port 310 of on/off the switch 55 in this time.

As shown in FIG. 11, the rotating member 320 may be rotated in the second direction B again. The opening/closing part 330 may close the opening 39*a* while the rotating member 320 rotates so that the USB port 310 and the switch 55 may be closed from the outside.

The USB device may be inserted into the recess portion 39 by rotation of the rotating member 320 in a state of being connected to the USB port 310 as illustrated in the drawings. When the USD port 310 faces the first direction A, the user may disconnect the USB device from the USB port 310 and then rotate the rotating member 320 toward the second direction B to close the opening 39*a*.

Since the USB connector 300 is disposed above the first door 31, the user may connect the USB device to the USB port 310 without opening the first door 31 as shown in FIG. 12.

Since it is impossible to connect the USB device to the USB port 310 when the refrigerator 1 is provided in a built-in form and the USB connector 300 is disposed at one side of the cabinet 10, the USB connector 300 may be disposed on the front side of the cabinet 10. It may be troublesome to connect the USB device to the USB port 310 after the door 30 is opened.

According to an embodiment of the present disclosure, the user may directly connect the USB device to the USB port 310 without moving the entire refrigerator 1 or moving the door 30.

Hereinafter, a refrigerator 1 including a switch 55' according to another embodiment of the present disclosure will be described. The configuration other than the switch 55' described below is the same as the configuration according to the above-described embodiment, and a duplicate description will be omitted.

Figure 13:
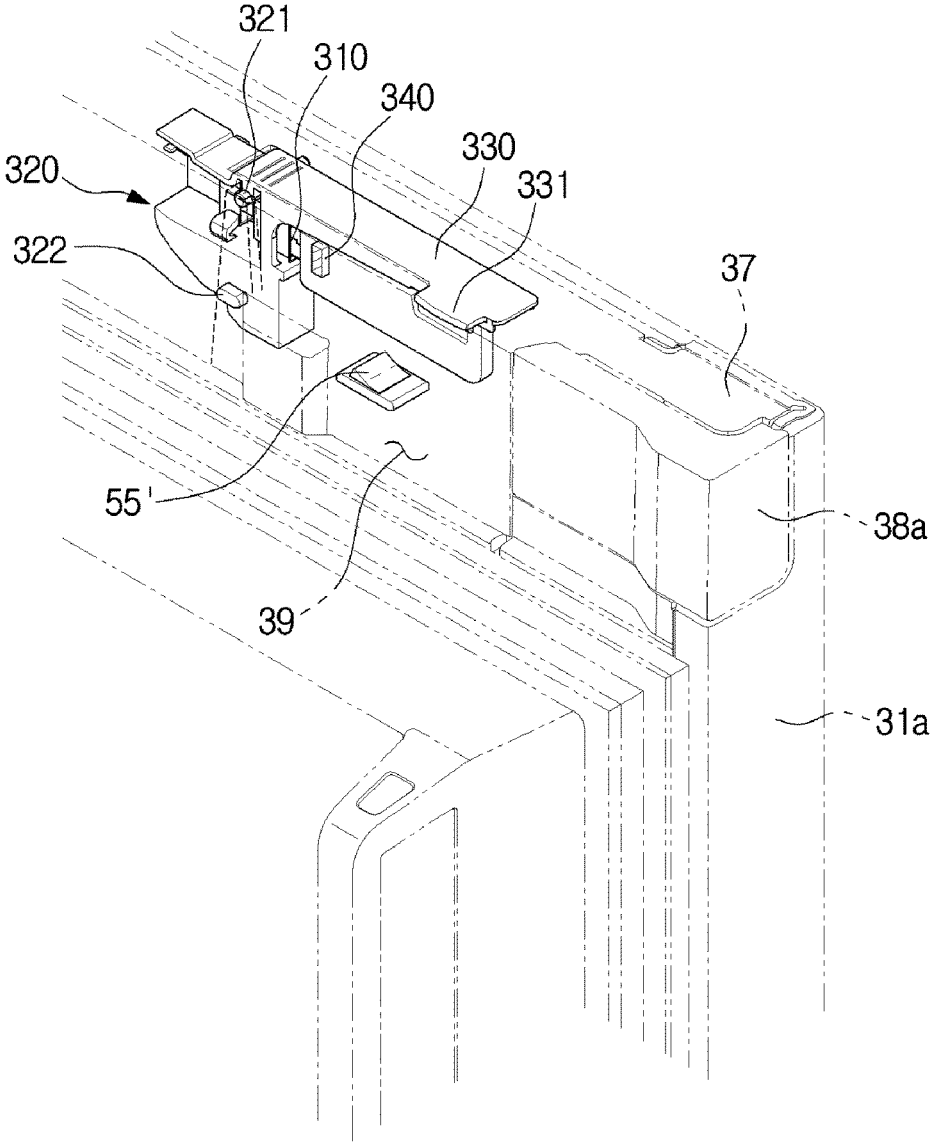
FIG. 13 is a rear perspective view of a door of a refrigerator when a port of the refrigerator is directed in a second direction according to another embodiment of the present disclosure.

FIG. 13 is a rear perspective view of a door when the port of the refrigerator is directed in the second direction according to another embodiment of the present disclosure.

A switch 55' for applying power to the display unit 50 may be disposed inside the recess portion 39. Unlike the embodiment of the present disclosure, it may be disposed on the bottom surface or the side surface of the recess portion 39 without being disposed on the rotating member 320.

Accordingly, when the opening/closing portion 330 opens the opening 39*a*, the user may operate the switch 55' by inserting his/her hand into the recess portion 39 through the opening 39*a*.

Several embodiments have been described but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

What is claimed is:

1. A refrigerator comprising:

a cabinet;

a storage compartment formed inside of the cabinet; and a door rotatably coupled to the cabinet to open or close the storage compartment, the door having a front panel, a rear portion disposed on an opposite side of the front panel, side panels to connect the front panel to the rear portion, a recess portion formed on one of the side panels, and a Universal Serial Bus (USB) connector provided in the recess portion, the USB connector comprising a USB port and a rotating member configured to rotate the USB connector with respect to the recess portion, wherein the USB connector is configured to rotate, along an axis of rotation substantially perpendicular to the front panel, between a first position and a second position so that when the USB connector is rotated to the first position to open an inside of the recess portion, the USB port is exposed and available for connection, and when the USB connector is rotated to the second position to close the inside of the recess portion, the USB port is not available for connection.

2. The refrigerator of claim 1, wherein the recess portion is recessed from a surface of the one of the sides thereby having an opening.

3. The refrigerator of claim 2, wherein the USB connector comprises an opening/closing portion configured to open or close the opening by a rotation of the rotating member, and the opening/closing portion opens the opening when the rotating member rotates to the first position and the opening/closing portion closes the opening when the rotating member rotates to the second position.

4. The refrigerator of claim 3, wherein the USB connector further comprises a stopper configured to limit a rotation of the rotating member.

5. The refrigerator of claim 3, wherein the USB port is provided to be located outside the opening by the rotation of the rotating member when the rotating member is rotated to the first position.

6. The refrigerator of claim 3, further comprising:

a display mounted on the door to provide a user interface for functions of the refrigerator; and a switch electrically connected to the display and disposed inside the recess portion.

7. The refrigerator of claim 6, wherein the switch is disposed on the rotating member and rotates in conjunction with the rotating member.

8. The refrigerator of claim 2, further comprising:

a speaker assembly disposed on an upper surface of the cabinet to be inclined with respect to the upper surface of the cabinet; and a cover member slidably disposed above the speaker assembly to cover the speaker assembly, wherein the speaker assembly is selectively exposed to the outside of the refrigerator by sliding the cover member.

9. The refrigerator of claim 4, wherein the stopper limits the rotation of the rotating member so that the an angle between the first position and the second position is less than or equal to 100 degrees.

10. A refrigerator comprising:

a cabinet including a storage compartment having an opening; and a door rotatably connected to the cabinet to open and close the opening of the storage compartment, and including a recess and a rotating member configured to rotate into and out of the recess on an axis of rotation perpendicular to a front surface of the door, wherein the front surface of the door is parallel to a front of the opening when the door is closed, and wherein the rotating member includes a Universal Serial Bus port that is exposed when the rotating member is rotated out of the recess and covered when the rotating member is rotated into the recess.

* * * * *